US006354867B1

(12) United States Patent
Tachi et al.

(10) Patent No.: US 6,354,867 B1
(45) Date of Patent: Mar. 12, 2002

(54) FEMALE ELECTRICAL CONNECTOR

(75) Inventors: Hideshi Tachi; Kiyofumi Ichida, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/678,308

(22) Filed: Oct. 3, 2000

(30) Foreign Application Priority Data

Oct. 5, 1999 (JP) ..... 11-284083

(51) Int. Cl.[7] ..... H01R 13/40
(52) U.S. Cl. ..... 439/488; 439/595
(58) Field of Search ..... 439/488, 595

(56) References Cited

U.S. PATENT DOCUMENTS 4,053,705 A * 10/1977 Schmidt ..... 174/138 F
5,256,083 A * 10/1993 Yamamoto ..... 439/595
6,062,906 A * 5/2000 Tanaka ..... 439/595
6,123,574 A * 9/2000 Matsuda et al. ..... 439/488

FOREIGN PATENT DOCUMENTS

EP 0 895 331 2/1999

* cited by examiner

*Primary Examiner*—Gary Paumen
*Assistant Examiner*—Ann McCamey
(74) *Attorney, Agent, or Firm*—Banner & Witcoff, Ltd.

(57) ABSTRACT

Female terminal fittings 15 are inserted into cavities 13 formed in a terminal housing 11 of a female housing 10, and are doubly retained therein by a retainer 30. Insertion grooves 28 are formed in an anterior portions of ceiling walls of the cavities 13, and cut-away grooves 37 are formed in anterior ends of an upper face of the retainer 30, these cut-away grooves 37 passing through to the insertion grooves 28. Innermost faces of the cut-away grooves 37 form inclined faces 38 which are inclined downwards. When the female terminal fittings 15 are housed within the cavities 13 and are doubly retained therein, upper faces of anterior ends of connecting members 16 are located directly below the insertion grooves 28. When a conductivity checking operation is performed, a conducting probe 40 is inserted from the anterior with a tip thereof being inclined downwards. The conducting probe 40 passes through the cut-away grooves 37 of the retainer 30, being guided by the inclined faces 38 at the innermost faces thereof. The conducting probe 40, while still in an inclined state, is inserted into the insertion groove 28 and makes contact with the relatively rigid upper face of the connecting member 16; damage to the terminal fittings is avoided.

10 Claims, 4 Drawing Sheets

FEMALE ELECTRICAL CONNECTOR

TECHNICAL FIELD

The present invention relates to a connector which houses terminal fittings.

BACKGROUND TO THE INVENTION

A conventional electrical connector has a female connector housing having a plurality of cavities, and female terminal fittings which have electric wires fixed thereto are housed in the cavities. In this type of connector, and particularly in multiple connectors, a conducting probe needs to make contact with each female terminal fitting in order to check whether the female terminal fittings have been housed in the correct cavity. An example of this conductivity test using probes is described in JP 11-45761.

The method of bringing the conducting probe into contact with the female terminal fitting in the conventional case is shown in FIG. 9 of this specification. A probe 4 is inserted in a straight line into a female terminal fitting 1 from an insertion hole 2 that is used for inserting a tab of a corresponding male terminal fitting. The probe 4 makes contact with a contacting member 3 which in use makes resilient contact with the tab.

The probe 4 is inserted and removed via a levering operation using a checking jig or the like, and the inserting stroke and inserting position of the probe 4 are fixed. However, if for some reason the probe 4 is inserted too deeply or in an inclined state, the contacting member 3 may be bent excessively, causing problems such as set-in fatigue.

The present invention has taken the above problem into account, and aims to present a connector wherein damage to the terminal fittings is prevented when their conductivity is checked.

SUMMARY OF THE INVENTION

According to the invention there is provided an electrical connector comprising a housing having a plurality of cavities formed therein in a fitting direction, and a plurality of electrical terminals inserted in respective cavities, characterized in that an opening is formed in the side wall of each cavity adjacent a respective terminal, the openings being adapted to receive a probe for checking conductivity of a respective terminal.

Preferably the cavities are open to a front face of the housing and permit insertion of a probe at an angle to the fitting direction. In a preferred embodiment, the openings comprise a slot at one end of each cavity.

The connector may include a retainer fitted from the front face thereof to doubly retain the terminals, the retainer including apertures aligned with the respective openings in the fitted condition. These apertures may have an angled wall to guide a probe into a respective opening.

The terminals preferably have a box-like external shape to better resist the contact force exerted by a probe.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

An embodiment of the present invention is described below with the aid of FIGS. 1 to 8. In the present embodiment, a female connector is described.

Figure 1:
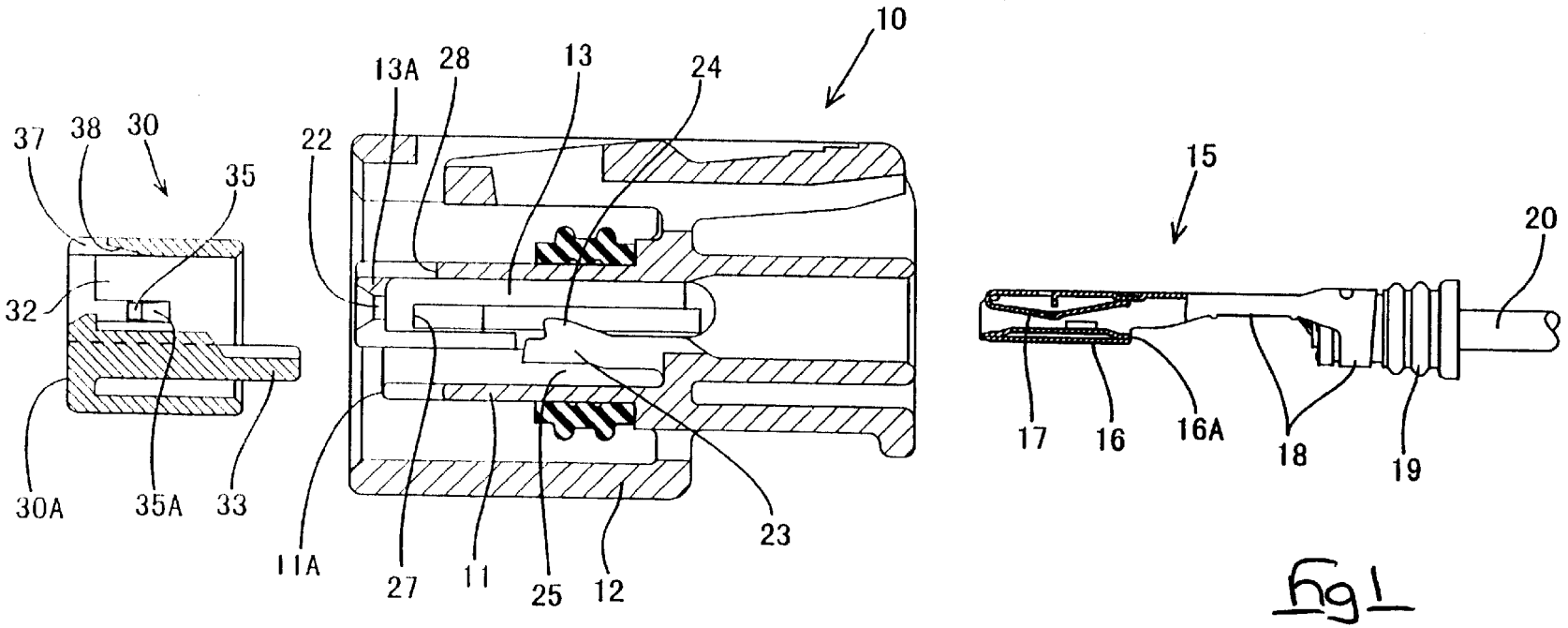
FIG. 1 is a cross-sectional view showing a female terminal fitting of an embodiment of the present invention in a state prior to being inserted.
Figure 2:
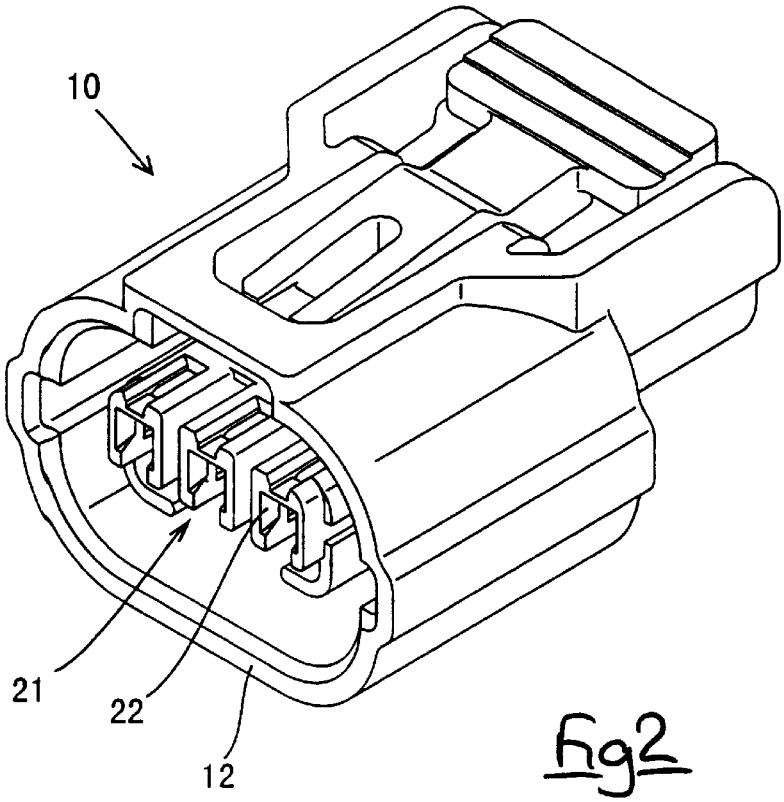
FIG. 2 is a diagonal view of the female housing.
Figure 3:
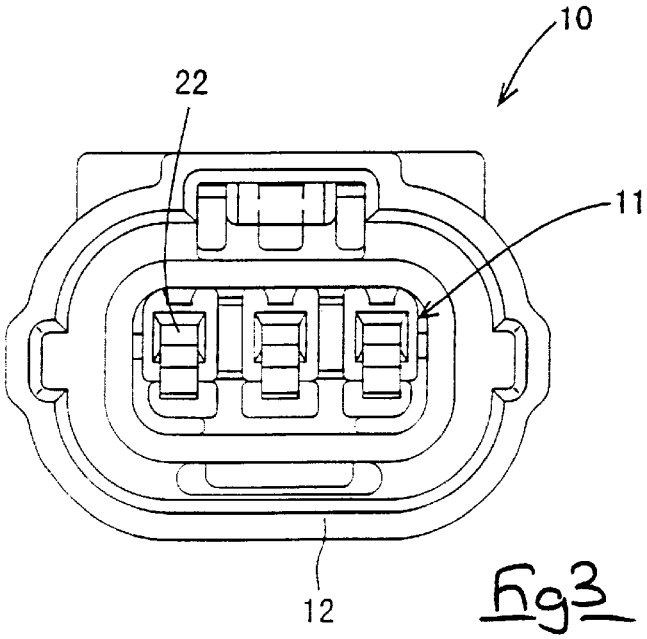
FIG. 3 is a front view of the female housing.

In FIGS. 1 and 2, the number 10 refers to a female connector housing (hereafter referred to simply as female housing) made from plastic, this female housing 10 having a terminal housing 11 which is approximately flat. A hood 12 is fitted around an anterior half of the terminal housing 11. Cavities 13 (three are shown) are horizontally aligned within the terminal housing 11. A lower portion of an anterior face of the terminal housing 11 is slightly concave, and an anterior side thereof is divided so as to keep each cavity 13 separate.

A female terminal fitting 15 is housed within each of the cavities 13. Each female terminal fitting 15 is formed by pressing from highly conductive sheet metal. An anterior end of the terminal fitting 15 forms a box-shaped connecting member 16, the center thereof being provided with a resilient contacting member 17 which is bent over in an angled manner from an anterior tip of a ceiling face of the connecting member 16. A posterior end of the terminal fitting 15 is provided with a barrel 18. This barrel 18 is fixed by crimping to a waterproof rubber stopper 19 and an end of an electric wire 20.

A terminal insertion hole 22 is formed in an anterior wall 13A of each cavity 13, this terminal insertion hole 22 allowing a tab (not shown) of a corresponding male terminal fitting to be inserted therein, and a lance 23 formed in a unified manner on a base face of each cavity 13. This lance 23 extends towards the anterior in a cantilevered shape, a protrusion 24 being formed on an upper face of this lance 23 at a location in the vicinity of the extending end thereof. This protrusion 24 engages with a posterior abutment 16A of the connecting member 16 of the female terminal fitting 15. A bending space 25 below the extending end of the lance 23 allows this lance 23 to be bent.

The terminal fittings 15 are inserted from the posterior into the cavities 13 and bend the lances 23, these fittings 15 being pushed in to a location where they make contact with the anterior walls 13A of the cavities 13. Then the lances 23 return to their original position and the protrusions 24 protrude to the posterior of the abutments 16A, thereby retaining the terminal fittings 15 in a latched state.

Figure 6:
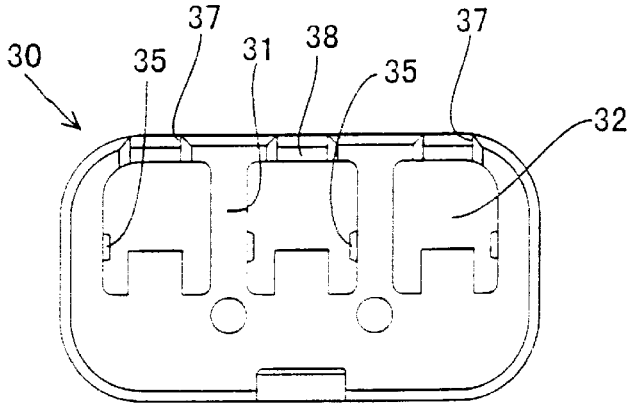
FIG. 6 is a front view of a retainer.
Figure 7:
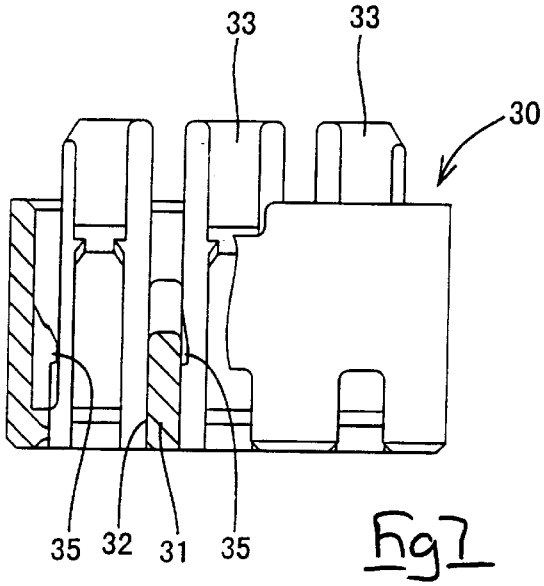
FIG. 7 is a partially cut-away plan view of the retainer.

The anterior side of the terminal housing 11 is provided with a front retainer 30 for doubly retaining the female terminal fittings 15. As shown in FIGS. 6 and 7, this front retainer 30 is formed in a rectangular cap-shape to cover the circumference of the anterior end portion of the terminal housing 11. Slightly more than an upper half of an anterior face thereof is open and is divided by dividing walls 31, thereby forming three window holes 32 which are horizontally aligned and correspond to the cavities 13 of the terminal housing 11. The two dividing walls 31 fit relatively tightly into spaces between portions which divide the terminal housing 11.

Regulating members 33 protrude downwards from the lower portion of the retainer 30, these regulating members 33 entering the bending spaces 25 of the lances 23 and regulating the bending of these lances 23.

As shown in FIG. 7, the means to lock the retainer 30 to the terminal housing 11 consists of long and narrow protruding members 35 which protrude in an anterior direction from inner faces of left and right side walls of the retainer 30, and from both opposing faces of the dividing walls 31. An anterior side, relative to the direction of attachment of the retainer 30 (the right side of FIG. 1), of each protruding member 34 forms a tapered guiding face 35A.

Figure 4:
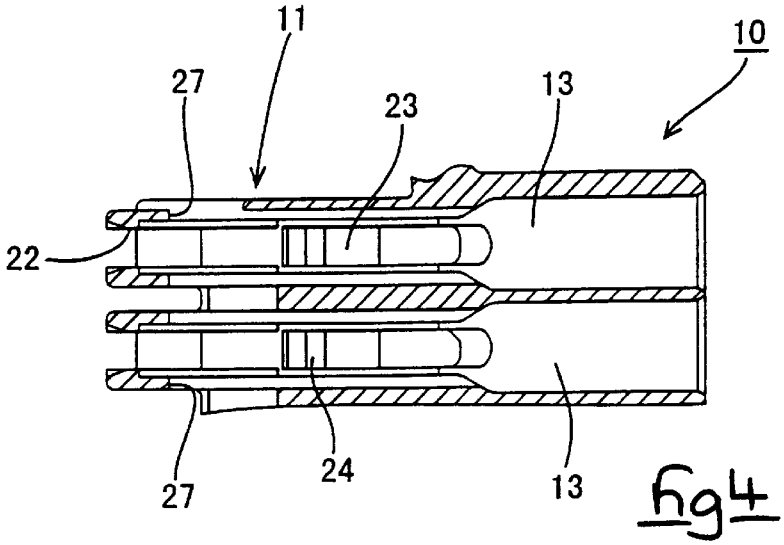
FIG. 4 is a partial cross-sectional view showing the configuration of the interior of a terminal housing.

As shown in FIG. 4, stopping holes 27 are formed on outer sides of side walls of the left and right side cavities 13, and on left and right side walls of the central cavity 13. The protruding members 35 engage with these stopping holes 27. When the retainer 30 is to be inserted in the terminal housing 11, an innermost face of an anterior wall 30A is pushed in until it makes contact with an anterior edge of a lower face of the terminal housing 11, and the protruding members 35 engage with the corresponding stopping holes 27, thereby locking the retainer 30.

Figure 5:
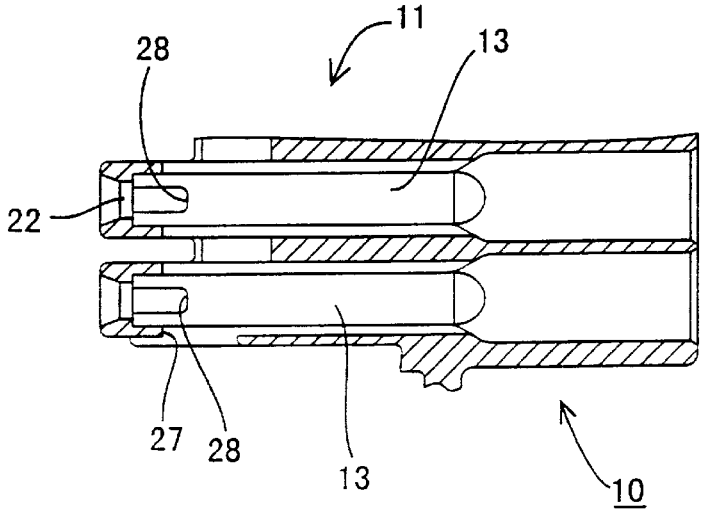
FIG. 5 is a partial cross-sectional view of the configuration of the interior of the terminal housing, as seen from above.

As shown in FIG. 5, a ceiling wall of each cavity 13 has an insertion groove 28 formed therein at a central portion of the anterior end thereof. These insertion grooves 28 are long and narrow in an anterior-posterior direction. As shown in FIG. 1, a specified dimension of the posterior ends of the insertion grooves 28 pass through to the anterior ends of the cavities 13. The anterior ends of the insertion grooves 28 are open at their anterior face.

Furthermore, cut-away grooves 37 are formed in the anterior end (the left side in FIG. 1) of the upper face of the retainer 30, each cut-away groove 37 being located in a position corresponding to the center (in a width-wise direction) of each window hole 32. When the retainer 30 is correctly fitted, openings of these cut-away grooves 37 are located in the vicinity of an inner side of the anterior walls 13A of the cavities 13 (see FIG. 8). Inclined faces 38 are formed on innermost faces of the cut-away grooves 37, these inclined faces 38 facing inwards and inclining downwards.

Next, the operation of the present embodiment is explained.

Figure 8:
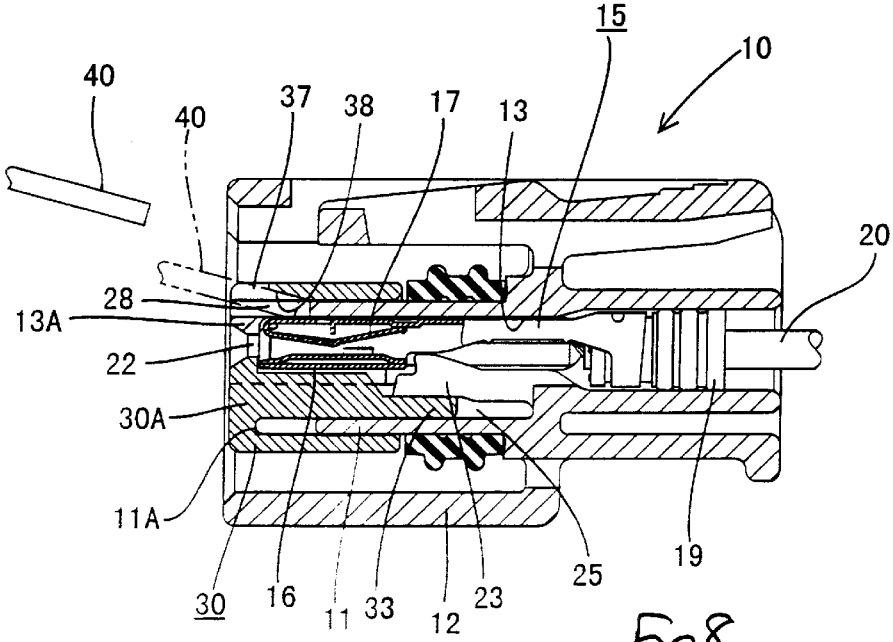
FIG. 8 is a cross-sectional view showing a conductivity checking state.
Figure 9:
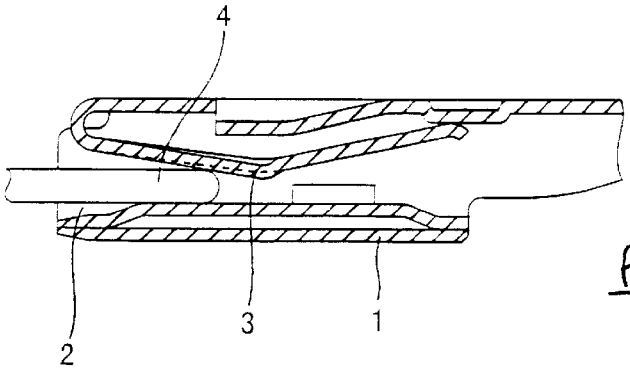
PRIOR ART Fig9
FIG. 9 is a cross-sectional view of a prior art example.

As has already been described, the female terminal fittings 15 are inserted from the posterior into the cavities 13 and the lances 23 bend. The female terminal fittings 15 are pushed in to a specified position, and the lances 23 return to their original position, thereby retaining the female terminal fittings 15 in a latched state. Next, the rubber stoppers 19 cover the openings of the cavities 13. At this juncture, as shown in FIG. 8, upper faces of anterior ends of the connecting members 16 of the female terminal fittings 15 are in a state whereby they are immediately below the insertion grooves 28.

After all of the female terminal fittings 15 have been inserted, the retainer 30 is pushed on so as to cover the anterior side of the terminal housing 11, and the protruding members 35 fits into the corresponding stopping holes 27, thereby locking the retainer 30. In this state, the regulating members 33 enter the bending spaces 25 of the lances 23 and prevent these lances 23 from bending, thereby doubly retaining the female terminal fittings 15 in a latched state.

After the attachment operation of the female connector is completed, the checking operation is performed to check whether each female terminal fitting 15 is correctly housed within the cavity 13. As shown in FIG. 8, a conducting probe 40, which is inserted into each cavity 13 and makes contact with the female terminal fittings 15, is inserted from the anterior, with a tip of this conducting probe 40 being inclined downwards. The conducting probe 40 passes through the cut-away groove 37, being guided by the inclined face 38 on the innermost face thereof, and is inserted, while still in an inclined state, into the insertion groove 28. A lower face of the conducting probe 40 makes contact with the upper face of the connecting member 16 of the female terminal fitting 15, thereby performing the checking operation.

In the present embodiment, when the conducting probe 40 makes contact with the female terminal fitting 15, it makes contact with the upper face of the box-shaped connecting member 16 which is comparatively rigid. Consequently, change of shape of the female terminal fittings 15, and in particular of the resilient contacting member 17, can be prevented.

The front faces of the cut-away grooves 37 and the insertion grooves 28, into which the conducting probe 40 is inserted, open in a manner so as to incline upwards. Consequently, the female terminal fittings 15 cannot readily be seen from the front faces, thereby decreasing the possibility of insertion of objects other than the conducting probe 40 therein. Furthermore, this configuration makes it more difficult for dirt or other foreign objects to enter the cavities 13.

The conducting probe 40 is inserted at an angle. Consequently, there is no need to provide a through hole in the hood 12.

The present invention is not limited to the embodiment described above with the aid of figures. For example, the possibilities described below also lie within the technical range of the present invention. In addition, the present invention may be embodied in various other ways without deviating from the scope thereof.

(1) The present invention is equally suitable for a connector using a retainer of a type other than a front retainer.

(2) The present invention is equally suitable for a male connector which houses male terminal fittings.

What is claimed is:

1. An electrical connector comprising a housing having a plurality of cavities formed therein in a fitting direction, each cavity having a terminal insertion hole that extends along an anterior face thereof, and a plurality of electrical terminals inserted in respective cavities, wherein an opening is formed in a side wall of each cavity adjacent a respective terminal such that an anterior end of each side wall opening is spaced from a respective one of the terminal insertion holes along the length of its respective cavity, the openings being adapted to receive a probe at an angle to the fitting direction for checking conductivity of a respective terminal.

2. A connector according to claim 1 wherein said terminals are substantially rectangular in cross section, and have an internal resilient contact arm, the external surface of said terminals each being accessible through a respective one of said openings.

3. A connector according to claim 1 wherein said cavities are open to a front face of said housing.

4. A connector according to claim 3 and further including a hood around said front face.

5. A connector according to claim 3 wherein said openings comprise a slot in a side wall of each cavity.

6. A connector according to claim 3 and further including a retainer insertable in said housing from said front face to a fitted condition, said retainer having apertures aligned with respective openings in the fitted condition.

7. A connector according to claim 6 wherein said apertures have a respective wall inclined to said fitting direction.

8. A connector according to claim 5 and further including a retainer insertable in said housing from said front face to a fitted condition, said retainer having apertures aligned with respective openings in the fitted condition.

9. A connector according to claim 8 wherein said apertures have a respective wall inclined to said fitting direction.

10. An electrical connector comprising a housing having a plurality of cavities formed therein in a fitting direction, each said cavity including a lance on a first side thereof, and a plurality of electrical terminals inserted in respective cavities, wherein an opening is formed in a side wall on a second side of each cavity opposite a respective one of said lances and adjacent a respective terminal, the openings being adapted to receive a probe at an angle to the fitting direction for checking conductivity of a respective terminal.

* * * * *